US005694849A

United States Patent [19]

Wehle et al.

[11] Patent Number: 5,694,849

[45] Date of Patent: Dec. 9, 1997

[54] OVERSHOOTING-SHEET SAFETY DEVICE

[75] Inventors: Josef Wehle, Schwetzingen; Helmut Buck, Schriesheim; Manfred Henn, Heidelberg, all of Germany

[73] Assignee: Heidelberger Druckmaschinen AG, Heidelberg, Germany

[21] Appl. No.: 565,117

[22] Filed: Nov. 30, 1995

[30] Foreign Application Priority Data

Nov. 30, 1994 [DE] Germany ..... 44 42 401.9

[51] Int. Cl.[6] ..... B41F 13/24; B65H 7/08

[52] U.S. Cl. ..... 101/233; 271/261; 200/61.42; 200/61.13; 101/409

[58] Field of Search ..... 101/233, DIG. 41, 101/415.1, 409; 271/261, 265.01, 265.02, 265.03, 3.13, 3.15, 3.17, 4.02, 4.03, 227, 228, 10.02, 10.03, 110

[56] References Cited

U.S. PATENT DOCUMENTS

| | | | |
|---|---|---|---|
| 1,231,463 | 6/1917 | Upham | 271/261 |
| 1,883,471 | 10/1932 | Barrett | 271/261 |
| 2,154,622 | 4/1939 | Backhouse | 271/261 |
| 2,635,545 | 3/1953 | Schubert | 271/261 |
| 2,708,405 | 5/1955 | Gegenheimer | 271/261 |
| 2,818,252 | 12/1957 | Nilsson | 271/261 |
| 3,065,961 | 11/1962 | Campbell et al. | 271/261 |
| 3,150,588 | 9/1964 | Bonsch | 101/233 |
| 3,208,376 | 9/1965 | Gates | 101/233 |
| 3,228,681 | 1/1966 | Williams et al. | 271/261 |
| 3,554,124 | 1/1971 | McIntire | 101/233 |
| 3,782,280 | 1/1974 | Jurny et al. . | |
| 3,875,860 | 4/1975 | Barber | 101/233 |
| 4,015,523 | 4/1977 | Evans et al. | 101/233 |
| 4,019,619 | 4/1977 | Emenaker et al. | 101/233 |

FOREIGN PATENT DOCUMENTS

| | | |
|---|---|---|
| 2 139 543 | 1/1973 | France . |
| 2 688 168 | 3/1993 | France . |
| 883 762 | 7/1953 | Germany . |
| 1 938 917 | 2/1971 | Germany . |
| 2 214 183 | 11/1972 | Germany . |
| 40 01 565 | 7/1991 | Germany . |
| 42 07 107 | 6/1993 | Germany . |
| 1 204 628 | 9/1970 | United Kingdom . |

*Primary Examiner*—Eugene H. Eickholt

*Attorney, Agent, or Firm*—Herbert L. Lerner; Laurence A. Greenberg

[57] ABSTRACT

Overshooting-sheet safety device for sheet deliveries of printing presses includes a triggering member responsive to overshooting sheets for triggering a stoppage of the printing press, the triggering member extending across the width of an oncoming sheet and being mounted in bearings at both sides thereof, the triggering member being deflectable perpendicularly to a line connecting said bearings for triggering a stoppage of the printing press.

11 Claims, 5 Drawing Sheets

OVERSHOOTING-SHEET SAFETY DEVICE

BACKGROUND OF THE INVENTION

Field of the Invention

The invention relates to an overshooting-sheet or early-sheet safety device for sheet deliveries of printing presses, having a triggering member responsive to overshooting sheets for triggering a stoppage of the printing press, the triggering member extending across the width of an oncoming sheet and being mounted in bearings at both sides thereof.

A problem which arises In sheet deliveries of printing presses is that a defect may cause a sheet to be guided beyond the paper stops of the pile delivery. This happens, for example, when the gripper bar conveying the sheet to the delivery has a defective gripper or a gripper which opens too late. In such a case, the sheet would be conveyed back to the delivery drum, and such a return of the sheet to the printing unit would result in damage to the printing press. For this reason, it is necessary that the printing press be stopped when such overshooting or early paper sheets occur.

In order to prevent such damage, a proposal has been made heretofore to introduce a row of limit switches into the path of such an overshooting sheet, the limit switches being actuated to stop the printing press. Many limit switches are required for this purpose, however. This is very costly both in materials and money.

An overshooting-sheet safety device has become known heretofore from the "Speedmaster" printing press of Heidelberger Druckmaschinen AG. This overshooting-sheet safety device is provided with a shaft which is mounted in the housing of the delivery and has arms with triggering elements formed of foam material. If an overshooting sheet comes into contact with the triggering elements, the shaft is rotated by the arms, and a limit switch at the end of the shaft is actuated, which results in the stopping of the printing press. This printing press has been provided with a further safety device, because the triggering sensitivity of the overshooting-sheet safety device is insufficient for the detection of all overshooting or early sheets. Moreover, an excessive amount of space was required for the safety device of this press. Moreover, the rigid suspension or mounting of the shaft increased the risk of an accident when a person reached in with his or her hand. The foam material triggering elements were often ripped off when crumpled sheets were removed, which, in turn, had an adverse effect upon the operation of the safety device. A further disadvantage was that, due to the tension of the chains of the delivery, the distance between the path of the gripper bars and the overshooting-sheet safety device varied, once again having an adverse effect upon the operation of the safety device.

SUMMARY OF THE INVENTION

It is accordingly an object of the invention to provide an overshooting-sheet safety device of the aforementioned general type which, while requiring less space, provides a high degree of operational safety.

With the foregoing and other objects in view, there is provided, in accordance with the invention, an overshooting-sheet safety device for sheet deliveries of printing presses, comprising a triggering member responsive to overshooting sheets for triggering a stoppage of the printing press, the triggering member extending across the width of an oncoming sheet and being mounted in bearings at both sides thereof, the triggering member being deflectable perpendicularly to a line connecting the bearings for triggering a stoppage of the printing press.

In accordance with another feature of the invention, the bearings of the triggering member are disposed on chain guides.

In accordance with a further feature of the invention, grippers for the oncoming sheet are movable past the triggering member, and triggering elements are disposed on the triggering member and project between the passing grippers.

In accordance with an added feature of the invention, the triggering member is formed of a cable with triggering elements disposed thereon, and a cable-tension sensor is operatively connected to the cable for detecting a deflection thereof.

In accordance with an alternative feature of the invention, the triggering member is formed of a shaft with triggering elements disposed thereon, and a sensor is operatively connected to the shaft for detecting a deflection thereof.

In accordance with an additional feature of the invention, the bearings of the shaft are formed as tripping cones for converting every deflection of the shaft into a movement of the respective bearing, on a side of the shaft at which the sensor is disposed, in the direction of the connecting line of the bearings, the movement of the respective bearing being detectable by the sensor.

In accordance with yet another feature of the invention, the sensor is a limit switch disposed on the respective bearing.

In accordance with yet a further feature of the invention, the overshooting-sheet safety device includes a toggle lever for transmitting the movement of the respective bearing to the limit switch.

In accordance with yet an added feature of the invention, the triggering member has triggering elements formed as tripping rollers.

In accordance with yet an additional feature of the invention, the triggering elements are formed as disc segments swivelably projectable in the direction of a potentially overshooting sheet so as to be swivelingly triggered thereby, the disc segments having an increasing radius with respect to a passing gripper bar carrying the grippers so as to strike against the gripper bar when swivelingly triggered by a respective overshooting sheet.

In accordance with a concomitant feature of the invention, the disc segments are disposed on a shaft swivelable together with the disc segments through a rotary angle defined by two limit pins disposed on the shaft and by respective stops cooperating with the pins, one of the pins being in contact with a respective one of the stops in a rest position of the triggering disc segments.

The invention offers the advantage that a high degree of triggering sensitivity is obtained with an overshooting-sheet safety device of simple and low-cost construction. This is achieved by the fact that even small deflections of the triggering member are detectable, regardless of the direction in which the deflection of the triggering member takes place.

This is particularly important if only parts of sheets, crumpled sheets or sheets and parts of sheets, respectively, wound around the gripper system are conveyed beyond the paper stops of the pile delivery. The fact that the triggering member yields to the side serves as an additional safeguard and reduces the risk of an accident, because an act of reaching into the press with a hand also causes such triggering and results in an immediate stopping of the printing press. The triggering member, in other words, additionally assumes the function of a finger-protection spindle.

A further development of the invention provides that the bearings of the triggering part are disposed on chain guides. This ensures that a constant distance is maintained between the overshooting-sheet safety device and the passing gripper bars, the distance not being influenced by the tension of the chains.

An advantageous embodiment provides that triggering elements be disposed on the triggering member, the triggering elements projecting between the passing grippers. This ensures that an overshooting sheet or parts thereof will always touch the triggering member, triggering the stopping of the printing press, even if parts of the sheet do not project in the direction of the triggering member.

An embodiment of the overshooting-sheet safety device provides for the triggering member to be formed of a cable with triggering elements disposed thereon, and a cable-tension sensor is provided for detecting the deflection. This is an especially space-saving embodiment which has a very high degree of sensitivity. Such cable-tension sensors have become known heretofore, for example, from the brochure "Sensoren für Position, Weg und Geschwindigkeit " [Sensors for Position, Displacement and Speed] from TEDEA Sensortechnik GmbH.

A further embodiment provides that the triggering member be formed of a shaft with triggering elements, and that the deflection of the shaft be detectable by a sensor. In this connection, for example, the bearings of the shaft may be in the form of tripping cones, the tripping cones converting each deflection of the shaft into a movement of the bearing on the sensor side in the direction of the connecting line, the movement being easily detectable by a sensor. The bearing may be associated with a limit switch as a sensor. The movement of the bearing can be transmitted, for example, by means of a toggle lever to the limit switch.

This embodiment of the triggering member likewise offers the advantage that even very small deflections are detected and, therefore, there is a rapid shutting-down of the printing press if an overshooting sheet or parts of an overshooting sheet appear. A further advantage is that a deflection in any direction results in the printing press being stopped, which is very important if triggering is also to take place as a result of crumpled sheets or sheets which have wrapped around the gripper system.

The triggering elements may, for example, be formed as tripping rollers. Alternatively, the triggering elements may be formed as disc segments, the disc segments swivelably projecting in the direction of a possible overshooting sheet and being of such construction that, as a result of a swiveling movement thereof triggered by an overshooting sheet, the disc segments push against the gripper bar due to the fact that they have an increasing radius with respect to the passing gripper bar. The disc segments may thus have a radius which increases in the direction of rotation; alternatively, rollers or segments may be eccentrically mounted. The advantage of this construction of the triggering elements is that the reaction of the triggering elements leads immediately to a swiveling motion, which is automatically continued, because the triggering elements come into contact with the gripper bar due to the increasing radius and are, consequently, swiveled away. This considerably increases the reliability of triggering, and it is possible to detect even relatively small pieces of overshooting paper, torn, for example, from a sheet.

Such triggering elements by means of an increasing radius may be disposed on a cable; alternatively, it is possible for the disc segments to be disposed on a shaft, the swiveling of the shaft with the disc segments being limited by two pins disposed on the shaft and by stops cooperating with the pins. It is advantageous for the triggering member to be of such construction that, in the normal state, a stop position is assumed. This ensures that the disc segments are always in an ideal engagement position.

Other features which are considered as characteristic for the invention are set forth in the appended claims.

Although the invention is illustrated and described herein as embodied in an overshooting-sheet safety device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
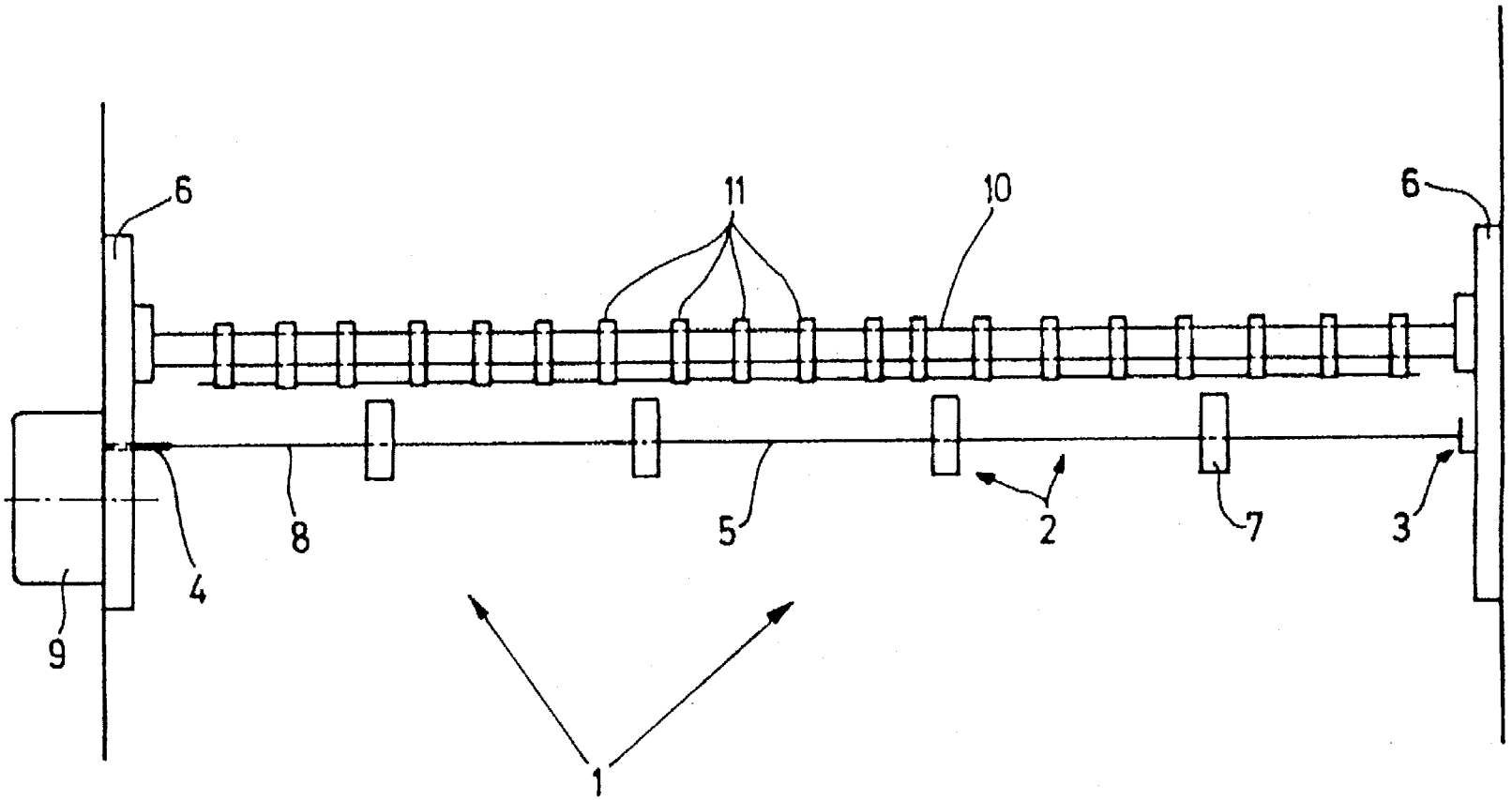
FIG. 1 is a diagrammatic top plan view of a basic first embodiment of the overshooting-sheet safety device according to the invention.

Referring now to the drawings and, first, particularly to FIG. 1 thereof, there is shown therein, in a basic sketch of a first embodiment of the invention, a triggering or releasing member 2 in the form of a cable 8 with triggering elements 7. The cable 8 is suspended by a bearing 3 on one side of a chain guide 6, and leads from there along a connecting line 5 to a bearing 4 on the other side of the chain guide 6, the cable 8 being connected on the latter side to a cable-tension sensor 9. The cable 8 and the triggering elements 7 are disposed so that a gripper bar 10, which fails to deposit the sheet properly on the pile and, due to a defective or non-opening gripper, conveys the sheet farther, guides the sheet against the cable 8 and/or the triggering elements 7 and, consequently, deflects the cable 8 out of the connecting line 5 between the bearings 3 and 4. The cable-tension sensor 9 responds to this deflection and causes a stoppage of the printing press in order to prevent the overshooting or early sheet from being conveyed back into the printing press.

Figure 2:
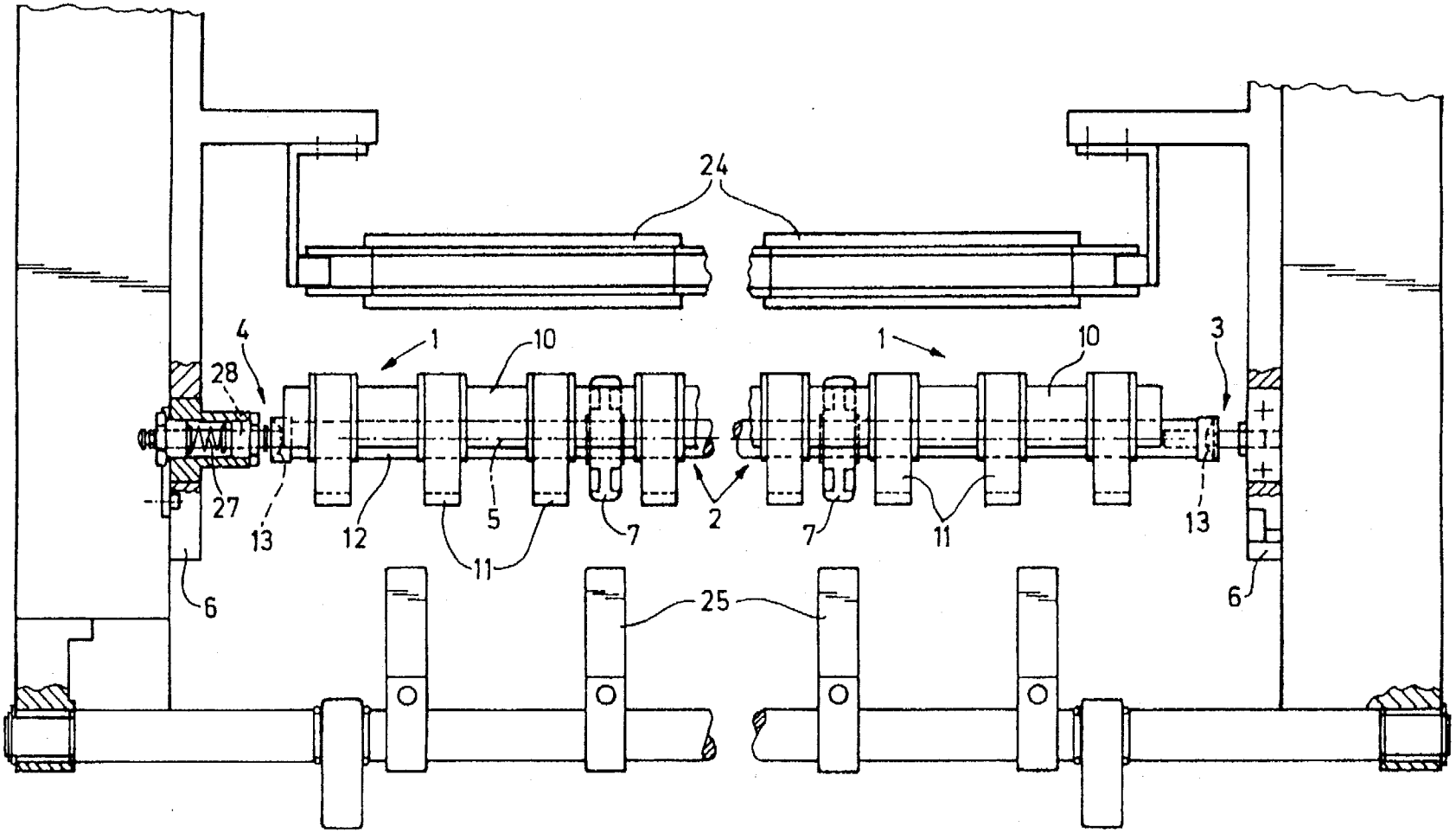
FIG. 2 is a more detailed top plan view of a second embodiment of the safety device.

FIG. 2 shows a second embodiment of the device according to the invention in a viewing direction of a person standing in front of the delivery of the printing press. The gripper bar 10 and the grippers 11 are located in a position at a level with the triggering member 2. If the grippers 11 have opened properly, the sheet drops onto the delivery pile, and comes into contact with a paper stop 25. Fans 24 ensure proper depositing of the sheet. If one of the grippers 11 fails to open properly, it may happen that a sheet or parts of a sheet are conveyed further. It is also possible that some other defect may lead to crumpled sheets or to a sheet being wrapped around the gripper system. In such a case, the overshooting-sheet safety device 1 must reliably stop the printing press.

In the embodiment of the invention shown in FIG. 2, the overshooting-sheet safety device 1 is in the form of a shaft 12 carrying triggering elements 7. The shaft 12 is mounted in bearings 3 and 4 by means of tripping cones 13. Such tripping cones 13 are formed of conical recesses 21 (note FIG. 6), wherein ends of bolts 28 and 28' in the form of conical or rounded sections 20 are received. The bolt 28 (FIG. 3) at the bearing 4, i.e., on the sensor side, is displaceable against a spring 27 which simultaneously ensures contact pressure in the bearings 3 and 4 necessary for holding the shaft 12. If an overshooting sheet touches the triggering elements 7 or the shaft 12, the latter is deflectable and the bolt 28 at the bearing 4 is displaced against the spring 27. In this manner, a deflection of the shaft 12 is converted, through the intermediary of the tripping cones 13, into a displacement of the bolt 28, which moves outwardly in the direction of the connecting line 5, where it actuates a sensor.

The bearings 3 and 4 are disposed on the chain guides 6, thereby assuring that, if the chains are subjected to tension, the overshooting-sheet safety device 1 is also adjusted therewith. In this manner, assurance is provided that the distance between the overshooting-sheet safety device 1 and the path of movement of the gripper bars 10 is always the same. Therefore, the tensioning of the chains by the adjustment of the chain guides 6 cannot have any adverse effect upon the operation of the press.

Figure 3:
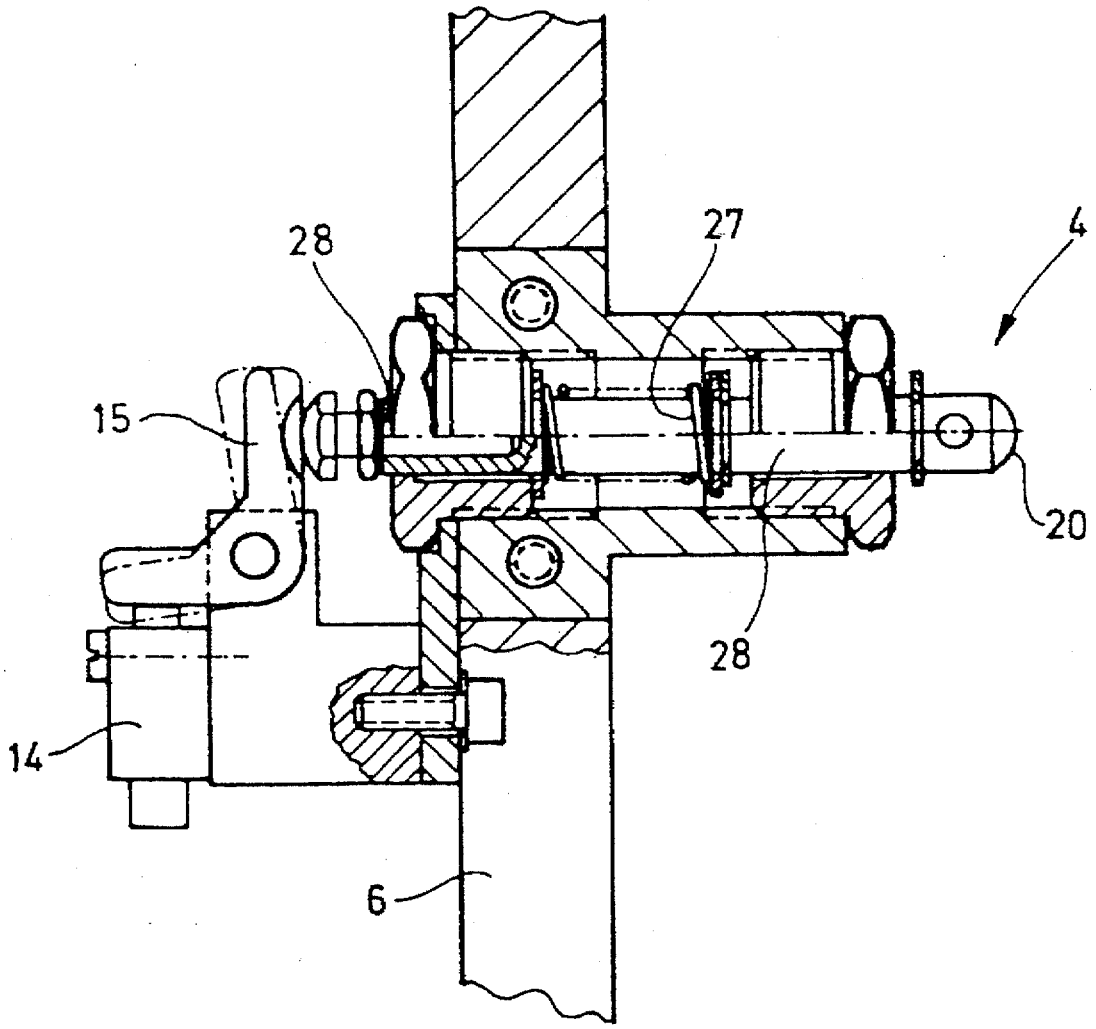
FIG. 3 is an enlarged fragmentary view of FIG. 2 showing in greater detail an arrangement of a limit switch forming part of the safety device.

FIG. 3 shows an arrangement of a limit switch 14 in an embodiment of the invention wherein the triggering member 2 is in the form of a shaft 12 with triggering elements 7. This figure shows the part of the bearing 4 disposed on the chain guide 6. The pin 28 displaceable against the spring 27 has a rounded section 20 at a forward end thereof. The rounded section 20 engages the conical recess 21 (not shown in FIG. 3) formed in the shaft 12. If the shaft 12 is deflected, the bolt 28 is displaced against the force of the spring 27 into engagement with a toggle lever 15 which transmits the displacement to a limit switch 14 which sends a signal appropriately causing the printing press to be stopped. Of course, a limit switch 14 can also be actuated directly by the bolt 28 or by means of a different conventional method of transmission.

Figure 4:
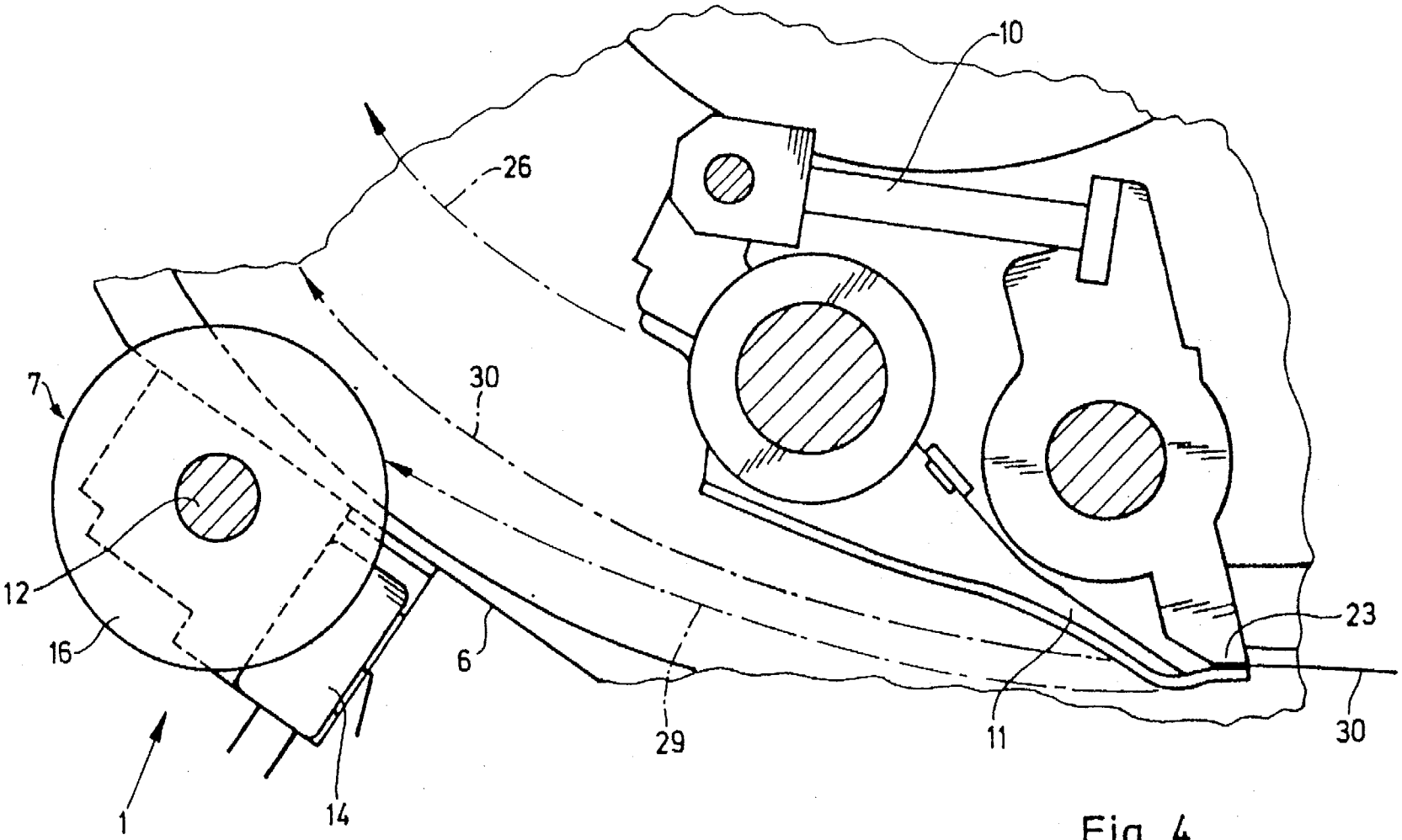
FIG. 4 is an enlarged side elevational view of the embodiment of FIG. 2.

FIG. 4 is a side elevational view of the second embodiment, as seen by a person located at the delivery and looking in the direction of the connecting line 5. The shaft 12 is shown in section, and a triggering element 7, in the form of a tripping roller 16, is visible in the foreground. Situated in the background is the limit switch 14, which may be made actuatable in the manner described just hereinbefore. The bearings 3 and 4 of the shaft 12 are disposed on the chain guides 6. Guided by means of the chains are gripper bars 10, which move along the path 26. The gripper bar 10 has grippers 11 which, in cooperation with gripper pads 23, hold a sheet 30. For properly depositing the sheet 30, the grippers 11 must open and the sheet 30 drop down onto the delivery pile. If the grippers 11 fail to open properly, the sheet 30 (overshooting sheet) is conveyed farther, describing the direction of movement represented by the arrow 29 shown in phantom and coming up against the triggering elements 7. This causes the aforedescribed triggering or release of the overshooting-sheet safety device 1.

Figure 5:
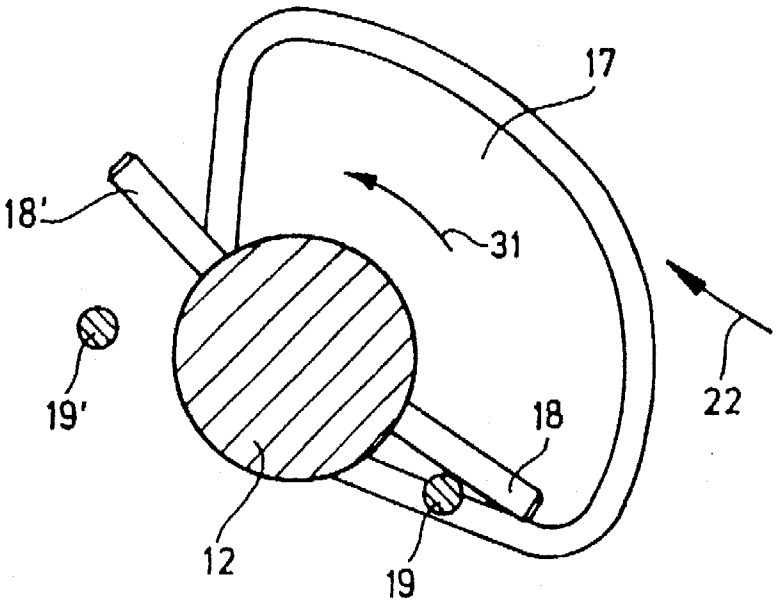
FIG. 5 is view like that of FIG. 4 of triggering elements which are in the form of disc segments.

FIG. 5 shows an embodiment of the triggering elements 7 in the form of disc segments 17. The viewing direction is the same as that in FIG. 4, the arrow 22 indicating the course of an overshooting sheet. If a sheet overshoots in this manner, the disc segments 17 swivel in the direction of the arrow 31 and, as a result thereof, the larger radius of the disc segments 17 moves in the direction of the passing gripper bar 10. This increased radius is of such dimensions that the disc segments 17 push against the gripper bar 10, and a deflection of the shaft 12 occurs. This ensures that a brief triggering of the overshooting-sheet safety device 1 is sufficient to effect the stopping of the printing press. It is thus possible for the overshooting-sheet safety device 1 also to react to torn pieces of paper. The shaft 12 is provided with pins 18 and 18', which cooperate with stops 19 and 19'. In the rest position, the pin 18 is in engagement with the stop 19 and, when the overshooting-sheet safety device 1 is triggered, the swiveling of the disc segments 17 is limited by the pin 18' and the stop 19'.

Figure 6:
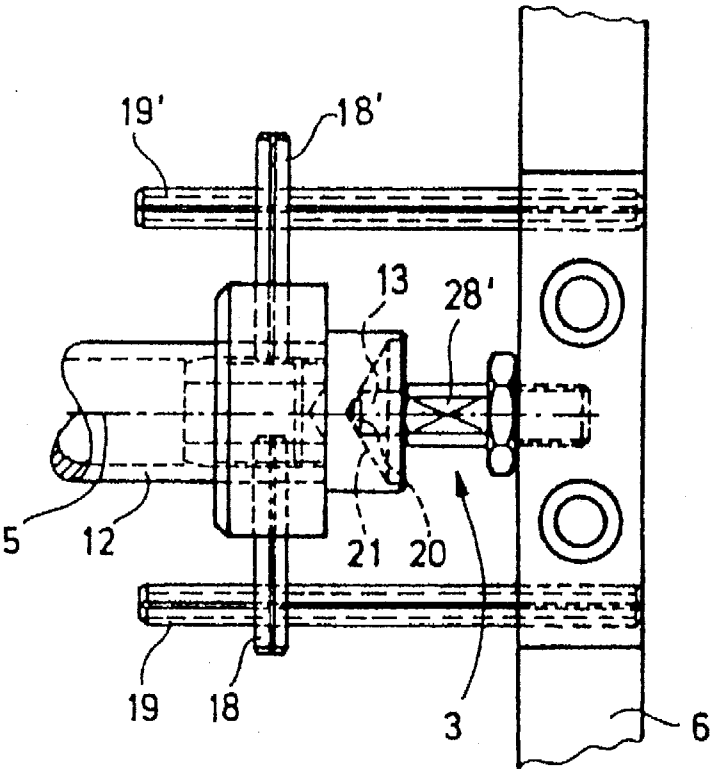
FIG. 6 is a view from the right-hand side of FIG. 5 illustrating limits of swiveling of the triggering elements formed as disc segments.

FIG. 6 is a top plan view of the device according to the invention showing this swiveling-limitation arrangement, it being discernible that the arrangement is disposed at the end of the shaft 12 in the vicinity of the bearing 3. The stops 19 and 19' are machined into the chain guide 6, and the pins 18 and 18', which cooperate with the stops 19 and 19', project radially from the end of the shaft 12. This representation also shows, once again enlarged, the tripping or switching cone 13, the bolt 28' being formed with a rounded section 20 which cooperates with the conical recess 21. In contrast with the bearing 4, the bolt 28' on this side is rigidly fixed.

We claim:

1. Overshooting-sheet safety device for sheet deliveries of printing presses, comprising a triggering member responsive to overshooting sheets for triggering a stoppage of the printing press, said triggering member extending across the width of an oncoming sheet and being mounted in bearings at both sides thereof, said triggering member being deflected perpendicularly to a line connecting said bearings for triggering a stoppage of the printing press.

2. Overshooting-sheet safety device according to claim 1, wherein said bearings of said triggering member are disposed on chain guides.

3. Overshooting-sheet safety device according to claim 1, wherein grippers for the oncoming sheet are movable past said triggering member, and including triggering elements disposed on said triggering member and projecting between the passing grippers.

4. Overshooting-sheet safety device according to claim 1, wherein said triggering member is formed of a cable with triggering elements disposed thereon, and including a cable-tension sensor operatively connected to said cable for detecting a deflection thereof.

5. Overshooting-sheet safety device according to claim 1, wherein said triggering member is formed of a shaft with triggering elements disposed thereon, and including a sensor operatively connected to said shaft for detecting a deflection thereof.

6. Overshooting-sheet safety device according to claim 5, wherein said bearings of said shaft are formed as tripping cones for converting every deflection of said shaft into a movement of the respective bearing, on a side of said shaft at which said sensor is disposed, in the direction of said connecting line of said bearings, said movement of the respective bearing being detectable by said sensor.

7. Overshooting-sheet safety device according to claim 6, wherein said sensor is a limit switch disposed on the respective bearing.

8. Overshooting-sheet safety device according to claim 7, including a toggle lever for transmitting said movement of the respective bearing to said limit switch.

9. Overshooting-sheet safety device according to claim 1, wherein said triggering member has triggering elements formed as tripping rollers.

10. Overshooting-sheet safety device according to claim 3, wherein said triggering elements are formed as disc segments swivelably projectable in the direction of a potentially overshooting sheet so as to be swivelingly triggered thereby, said disc segments having an increasing radius with respect to a passing gripper bar carrying said grippers so as to strike against said gripper bar when swivelingly triggered by a respective overshooting sheet.

11. Overshooting-sheet safety device according to claim 10, wherein said disc segments are disposed on a shaft swivelable together with said disc segments through a rotary angle defined by two limit pins disposed on said shaft and by respective stops cooperating with said pins, one of said pins being in contact with a respective stop in a rest position of said triggering disc segments.

* * * * *